United States Patent [19]

Levy

[11] 4,180,754

[45] Dec. 25, 1979

[54] GEIGER-MUELLER TUBE WITH A RE-ENTRANT INSULATOR AT OPPOSING SEALED ENDS THEREOF

[75] Inventor: Stephen Levy, Monmouth County, N.J.

[73] Assignee: The United States of America as represented by the Secretary of the Army, Washington, D.C.

[21] Appl. No.: 883,552

[22] Filed: Mar. 6, 1978

[51] Int. Cl.[2] ..... H01J 17/04; H01J 17/18; H01J 5/20

[52] U.S. Cl. ..... 313/93; 313/220; 313/242; 313/281; 313/335

[58] Field of Search ..... 313/93, 220, 335, 281, 313/242

[56] References Cited

U.S. PATENT DOCUMENTS

| | | | |
|---|---|---|---|
| 2,324,557 | 7/1943 | Claesson | 313/335 X |
| 2,776,390 | 1/1957 | Anton | 313/93 |
| 3,784,860 | 1/1974 | Cocks et al. | 313/93 |
| 3,903,444 | 9/1975 | Tessler | 313/93 |

*Primary Examiner*—Palmer C. Demeo

*Attorney, Agent, or Firm*—Nathan Edelberg; Jeremiah G. Murray; Daniel D. Sharp

[57] ABSTRACT

An improved cylindrical Geiger-Mueller tube with a life at least ten times greater than that heretofore obtainable includes a re-entrant insulator at each end of the tube to support the coaxial anode and to shield the tube ends from the Geiger discharge.

5 Claims, 3 Drawing Figures

GEIGER-MUELLER TUBE WITH A RE-ENTRANT INSULATOR AT OPPOSING SEALED ENDS THEREOF

GOVERNMENT LICENSE

The invention described herein may be manufactured and used by or for the Government for governmental purposes without the payment of any royalties thereon or therefor.

BACKGROUND OF THE INVENTION (a) Field of the Invention

Broadly speaking, this invention relates to radiation detection. More particularly, in a preferred embodiment, this invention relates to an improved radiation detection tube having a useful life which is at least one order of magnitude greater than that therefore obtained.

(b) Discussion of the Prior Art

Radiation detectors find widespread application in both civil and military environments. By far the most common detector is the Geiger-Mueller tube which is less expensive and more rugged than the scintillation counter.

Unfortunately, the Geiger-Mueller tube has been found to have a limited life, which is believed to be caused by cathode degradation in the region of the insulator-cathode seal. For example, prior to the instant invention, commercial G-M tubes, especially small-sized units, had useful lives of from $10^9$ to $10^{10}$ counts when operated at moderate loadings and moderate over-voltages. The end of useful tube life occurs when the counter no longer yields an accurate measure of gamma-radiation. The end of useful life could result, for example, from the end of the tube's plateau voltage falling below the operating point. This reduction in plateau length results from increased secondary electron emission from the tube's cathode and manifests itself as multiple tube counts.

Investigation has revealed that the undesirable secondary emission is caused by damage to the cathode's passivation layer. More particularly, within the G-M tube, the abrupt termination of the glass frit seal and the metal electrodes distorts the applied electric field creating field intensities of such magnitude that the aforementioned damage to the passivation layer can occur. The above observations have been confirmed by the use of a scanning electron microscope which clearly revealed the existence of an abrupt insulator-metal interface in the cathode seal region of several commercial G-M tubes. Of course, in such tubes the secondary emission would increase with rising voltage to the point where multiple tube counts would cause the G-M tube to go into continuous discharge.

SUMMARY OF THE INVENTION

The problem, then, is to design a Geiger-Mueller tube which has an insulator design such that not only are the anode and cathode electrically isolated, one from the other, but the dielectric-metal interface is shielded from the Geiger discharge.

As will be disclosed below, this problem has been solved by a re-entrant insulator design which can be applied to an all cylindrical metal-walled G-M counter. In this novel design, the shielding of the discharge from the field-distorted region near the dielectric-metal interface means that the ions that reach the cathode will impinge upon its passivated surface far more uniformly and with less destructive energy than heretofore. This results in a more stable Geiger-Mueller plateau and hence a longer useful life.

The invention and its mode of operation will be more fully understood from the following detailed description when taken with the appended drawing in which:

DETAILED DESCRIPTION OF THE INVENTION

Figure 1:
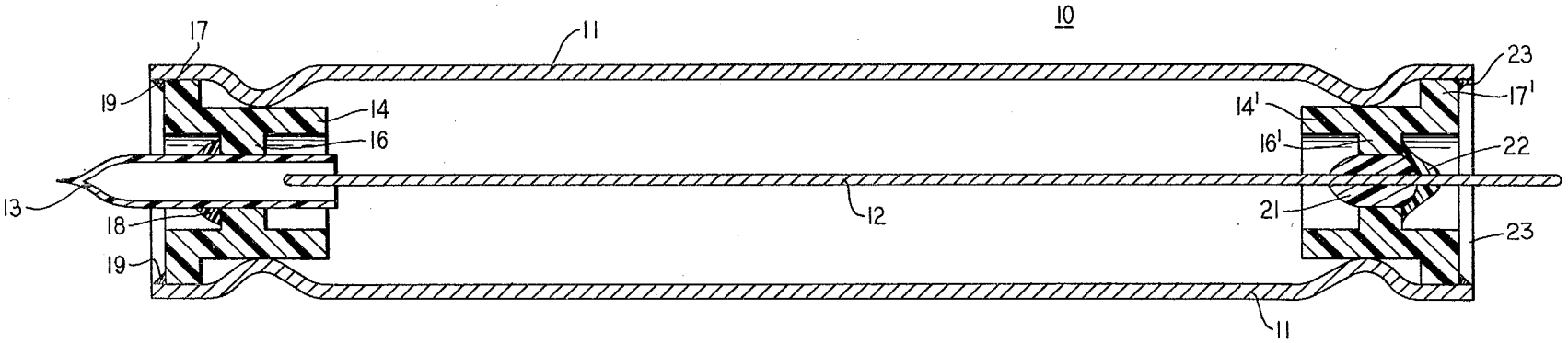
FIG. 1 is a cross-sectional view of an illustrative Geiger-Mueller tube with a re-entrant insulator according to the invention.

FIG. 1 is a cross-sectional view of an illustrative Geiger-Mueller tube according to the invention. It will be understood that the particular tube shown is not intended to be limiting and that the invention has application to Geiger-Mueller tubes of other configurations. Indeed, in its broadest sense, the invention is not limited to Geiger-Mueller tubes at all, but has application to any electronic device where a distorted electric field contributes to destruction of a passivation layer and hence secondary electron emission.

As shown, Geiger-Mueller tube 10 comprises a cylindrical metal cathode 11 with a metal anode 12 coaxially positioned therein. At one end, anode 12 is surrounded by a glass tubulation 13 which is used to evacuate the tube and then to introduce the desired gas mixture. Glass tubulation 13, in turn, is supported by a re-entrant insulator 14 which has an inwardly extending portion 16 and an outwardly extending portion 17 at the far end thereof.

A glass-frit seal 18 seals the inwardly extending portion 16 to the tubulation 13 while a second glass-frit seal 19, through which the tubulation 13 extends, seals the ends of insulator 14 and cathode 11.

In like fashion, at the other end of the tube, anode 12 is supported by a glass bead spacer 21 which, in turn is supported by a second re-entrant insulator 14' essentially identical to insulator 14 at the other end of the tube. A third glass-frit seal 22 seals the anode 12 to the glass bead spacer 21 and the inwardly extending portion 16'. A fourth glass-frit seal 23 seals insulator 14' to the cathode 11.

As previously mentioned, the tube 10 is first evacuated through tubulation 13, then filled with a suitable gas mixture, for example, a halogen-rare gas mixture comprising 175 Torr of 6.2% Neon, 0.10% Argon and 93.7% Helium plus 2.5 Torr of Bromine. The electrodes may comprise any of the metals heretofore employed, for example, copper which has been chromium plated. At least the surface of the chromium plating should be oxidized to form chromium sesqui-oxide to form a protective layer which keeps the gases, particularly the Bromine, from direct contact with the electrodes. Alternatively, the anode may comprise pure tungsten and the cathode a Chromium Manganese, Silicon, Carbon Iron alloy. Electrical connection to the tube is made by way of a wire ring positioned about the outside of the cathode and a crimped lug positioned around the anode wire extension (not shown).

Figure 3:
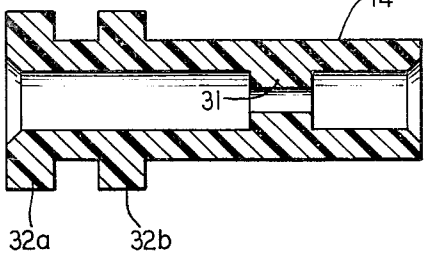
FIG. 3 is a cross-sectional view of yet another alternative insulator which is self-aligning.
Figure 2:
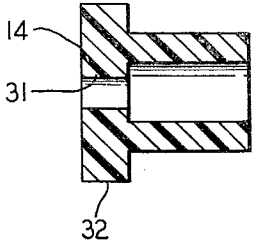
FIG. 2 is a cross-sectional view of an alternative insulator of somewhat simpler design.

FIGS. 2 and 3 respectively depict alternate embodiments for insulators 14 and 14'. The embodiment shown in FIG. 2, for example, is a somewhat simpler design wherein the inwardly extending portion 31 and the outwardly extending portion 32 are aligned.

The embodiment shown in FIG. 3 is more complex. However, it has the advantage that it is self-aligning within the cathode shell while still keeping the inner frit-seal protected from the outside, the tube thus being less susceptible to damage. The self-aligning feature is obtained by splitting the outwardly extending portion 32 into two separate portions 32*a* and 32*b*, as shown.

Insulators 14, 14' are advantageously made from glass or ceramic, although other non-conducting materials of similar characteristics may also be used.

In summary, the novel re-entrant insulator disclosed and claimed herein yields a Geiger-Mueller tube which:

(1) has a longer tube life—at least a tenfold increase in counts before failure;

(2) a more stable and longer Geiger plateau; and (3) the ability to alter the length of insulator protruding into the tube, thus permitting the tailoring of the active volume and, hence, controlling the radiation response of the tube without altering its overall physical dimensions.

One skilled in the art can make various changes and substitutions to the layout of parts shown without departing from the spirit and scope of the invention.

What is claimed is:

1. A Geiger-Mueller tube within which a geiger discharge is produced comprising:

a tubular cylindrical cathode, an elongated metal anode coaxially disposed within said cathode along the longitudinal axis of said cathode, a gaseous medium disposed in the space between said cathode and said anode, a dielectric support member at each end of said cathode, each including an axially extending tubular body portion, a first projecting portion adjacent one end of said body portion and extending radially outward from said body portion and a second projecting portion extending radially inward from said body portion and spaced from the end of said body portion remote from said first projecting portion, first dielectric sealing means for sealing said first projecting portion of said member to said cathode adjacent the corresponding end of said cathode, the other ends of each of said members removed from said corresponding first projecting portion forming a longitudinal boundary of the geiger discharge region of the tube, second dielectric sealing means for sealing said second projecting portion of one of said members to a region of said anode juxtaposed to said second projecting portion which is disposed outside the longitudinal boundaries of said geiger discharge region, the outer surface of each of said body portions in the region of said longitudinal boundary being spaced from said cathode to shield the geiger discharge from distorted electric fields occurring at the interface of the corresponding first projecting portion and said cathode, and the inner surface of the body portion of said one member in the region of said longitudinal boundary defined by said other end of said one member being spaced from said anode to shield the geiger discharge from the distorted electric field occurring at the interfaces of said second dielectric sealing means and said anode.

2. A Geiger-Mueller tube according to claim 1 further comprising:

a glass tubulation surrounding the end of said anode remote from said second dielectric sealing means, and third sealing means for sealing the second projecting portion of said other dielectric member to said tubulation.

3. A Geiger-Mueller tube according to claim 1 wherein said first and second projecting portions of each of said dielectric support members are substantially aligned.

4. A Geiger-Mueller tube according to claim 1 wherein said second projecting portion of each of said dielectric support members is disposed intermediate the ends of the corresponding dielectric support member.

5. A Geiger-Mueller tube according to claim 3 wherein each of said dielectric sleeves includes an additional pair of aligned outwardly extending and inwardly extending portions spaced from the pair of aligned first and second projecting portions recited in claim 3 to provide for self alignment of the corresponding dielectric members within said tubular cathode.

* * * * *